US005517719A

United States Patent [19]

Christ

[11] Patent Number: 5,517,719

[45] Date of Patent: May 21, 1996

[54] ADJUSTABLE DELAYED-ACTION DOOR CLOSER

[76] Inventor: Manfred Christ, 4402 Pettit Avenue, Niagara Falls, Ontario, Canada, L2E 6L1

[21] Appl. No.: 332,632

[22] Filed: Oct. 31, 1994

[30] Foreign Application Priority Data

Nov. 1, 1993 [GB] United Kingdom ..... 9322491

[51] Int. Cl.[6] ..... E05F 3/00; E05F 5/06

[52] U.S. Cl. ..... 16/49; 16/82; 16/85

[58] Field of Search ..... 16/49, 66, 82, 16/85, 86 R, 86 A; 251/64

[56] References Cited

U.S. PATENT DOCUMENTS

| | | | |
|---|---|---|---|
| 2,063,526 | 12/1936 | Snowdon | 16/49 |
| 3,555,591 | 1/1971 | Sogoian | 16/49 |
| 4,920,609 | 5/1990 | Lin | 16/85 |

*Primary Examiner*—W. Donald Bray
*Attorney, Agent, or Firm*—Fredrikson & Byron

[57] ABSTRACT

An adjustable delayed-action door closing device, particularly for use with screen doors or storm doors. The device comprises a cylindrical housing with a piston disposed within with the cylindrical housing. A biasing mechanism urges the piston into the cylindrical housing and a controlling mechanism controls the rate at which the piston is so urged. The shaft of the piston has a section of greater diameter than the remainder of the shaft a compression member cooperatively located within the cylindrical housing. The compression member is compressible to a diameter equal to or less than the greater diameter of the shaft, to provide friction contact with the greater diameter of the shaft when it is located within the compression member. A mechanism to pre-set and adjust the degree of friction contact of the compression member and the section of the shaft with greater diameter is provided.

10 Claims, 2 Drawing Sheets

ADJUSTABLE DELAYED-ACTION DOOR CLOSER

FIELD OF THE INVENTION

This invention relates to mechanisms for closing doors, and more particularly, to an adjustable delayed-action door closer for use on screen doors, storm doors, and the like.

BACKGROUND OF THE INVENTION

Typical screen and storm doors available on the market have an existing closing device already associated with them. The existing closing device serves two main functions. Firstly, the closing device is biased so as to ensure that the door closes when it is not held open. The second function of the existing closing device is to ensure that the storm door does not slam shut when it is closing, but rather the door is caused to close slowly.

Existing closing devices essentially comprise a cylindrical tube, a piston-like member disposed in the cylindrical tube, biasing means forcing the piston-like member to one end of the cylindrical tube, and means for controlling the rate at which the piston-like member is forced to that one end.

In use, the existing closing device is suitably connected between the frame of the door and the door. As the storm door is opened, the shaft of the piston-like member is forced out of the cylindrical tube, thereby compressing the spring. When the door is released, the spring causes the piston-like member to return to its original location, thereby causing the door to close. The rate at which the door is closed is dependent on the rate at which the piston-like member is allowed to return to its original location.

Existing closing devices for storm doors can be fitted with a stopping means on the shaft of the pistonlike member. The purpose of the stopping means is to prevent the piston-like member from returning into the cylinder, thus keeping the storm door open. However, in order for the user to keep the storm door open with the stopping means, he must adjust the relative position of the stopping means on the shaft of the piston-like member, and ensure that the stopping means is locked in position.

There is a further disadvantage with the existing closing devices for storm doors. It is almost always the case that upon opening an existing storm door, the householder is left performing a juggling act to find keys, balance bags or parcels, while at the same time bracing the storm door open with a knee, elbow, hip or ankle. The result is often a bruise, torn hosiery or frayed tempers.

Since existing storm doors are designed to immediately begin closing at a controlled rate, it would be convenient to have a door closer which permits the door to remain almost completely open for a pre-determined period of time. This time period would be sufficiently long to allow the householder unrestricted activity through the doorway. It would be particularly convenient and advantageous to have this open time period pre-adjusted, thus avoiding the requirement of sliding the stopping means into place every time the door must be kept open.

SUMMARY OF THE INVENTION

The door closing device of the present invention addresses these and other disadvantages of existing door closers by providing an adjustable delayed-action door closing mechanism that allows the user to cause the exterior storm door to be held in the open position for a pre-defined period of time. Upon expiration of this time period, the storm door will close in its normal fashion, that is, in the same way as existing door closers.

In one aspect, the present invention provides an adjustable delayed-action door closing device comprising:

- a cylindrical housing having first and second ends, adapted to be attached by said first end to the door;
- a piston disposed within with the cylindrical housing, said piston comprising a shaft and a piston head, said shaft extending beyond the cylindrical housing from the second end and having attachment means thereon;
- a biasing mechanism to urge the piston into the cylindrical housing and a controlling mechanism on said second end adapted to control the rate at which the piston is so urged;
- the shaft of the piston having a section of greater diameter than the remainder of the shaft,
- a compression member cooperatively located within said second end of the cylindrical housing through which said shaft passes, said compression member being compressible to a diameter equal to or less than the greater diameter of the shaft, to provide friction contact with the greater diameter of the shaft when said greater diameter is located within the compression member; and
- a mechanism to pre-set and adjust the degree of friction contact of the compression member and the section of the shaft with greater diameter.

The present invention Will be described in detail with reference to the embodiments shown in the accompanying drawings, in which.

DETAILED DISCUSSION OF THE INVENTION

Figure 1B:
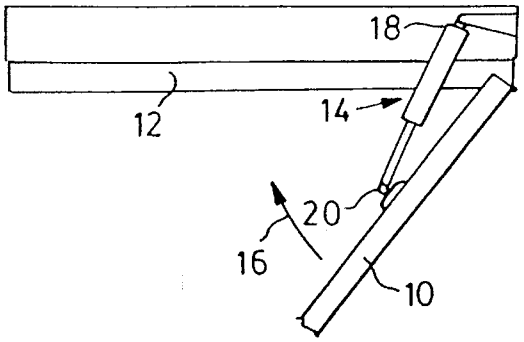
FIGS. 1A and 1B are schematic representations of the door closing device of the present invention as typically connected to a door and associated door frame.
Figure 1A:
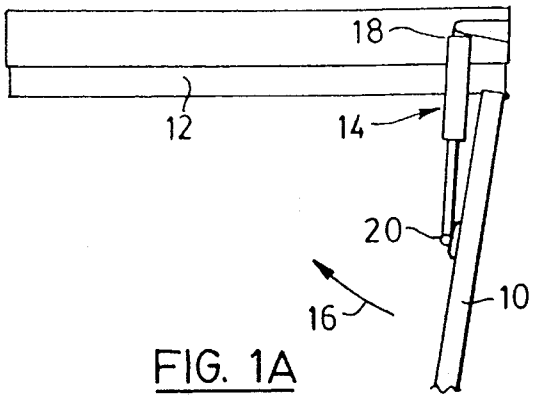

With reference to FIGS. 1A and 1B, there is shown a storm door 10, a frame 12 for door 10 and door closing device 14 of the present invention. Door closing device 14 is connected to door 10 and frame 12 in the usual manner. End 18 of door closing device 14 is connected to frame 12 by means of shaft 28 (see FIG. 2), which may be a rod, whereas end 20 of door closing device 14 is connected to door 10.

As is well known, door 10 is hingedly connected to frame 12 via hinges (not shown). The door closing device 14 is biased so as to cause door 10 to swing in the direction of arrow 16 when the door is opened and then released. The rate or speed at which door 10 swings in the direction of arrow 16 (that is, closes) is dependent on the adjustments made to door closing device 14. The operation of door closing devices has heretofore been known.

Door closing device 14 of the present invention, however, allows door 10 to remain in its open position for a predetermined period of time prior to door 10 beginning to close in the usual way.

Figure 2:
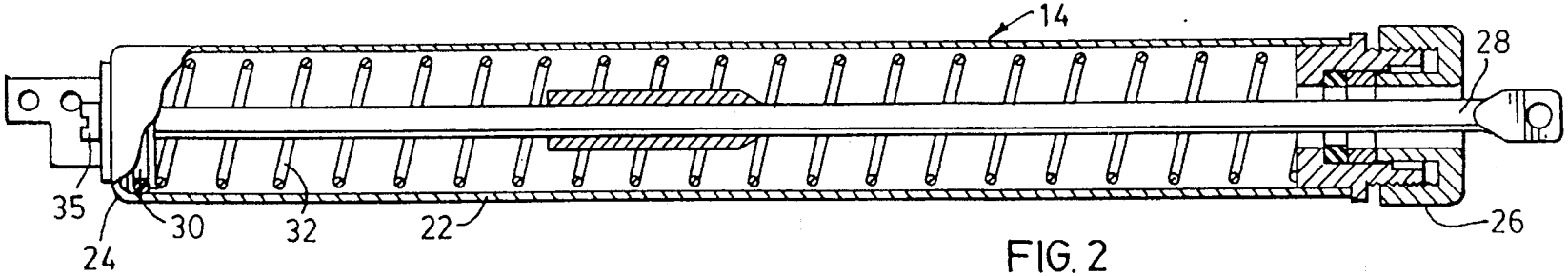
FIG. 2 is a schematic representation of cross-sectional view of the door closing device of the present invention with the piston-like member in its first position.
Figure 3:
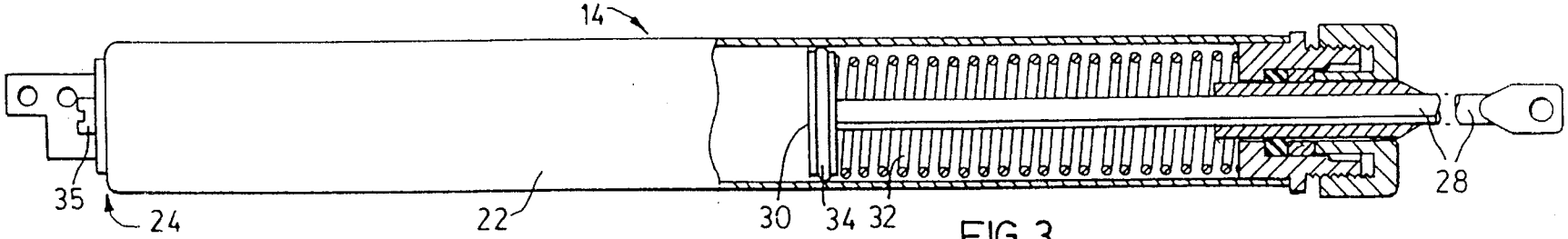
FIG. 3 is a schematic representation of a cross-sectional view of the closing device of the present invention with the piston-like member in its second position.

With reference to FIGS. 2 and 3, a cross-sectional view of door closing device 14 of the present invention is shown. Door closing device 14 includes a cylindrical housing 22 having a first end 24 and a second end 26. First end 24 is essentially closed, except for the provision of means that allow the user to control the rate at which door closing device 14 causes the door 10 to close, as discussed below. Second end 26 is also essentially closed, except for a central opening through which shaft 28 slides.

Door closing device 14 of the present invention also includes a piston-like assembly having elongate shaft 28 and a piston head 30. Device 14 also includes biasing means 32, such as a spring, disposed between piston head 30 and second end 26. Biasing means 32 urges piston head 30 towards first end 24 of cylinder housing 22.

Referring to FIG. 3, device 14 is shown with the piston-like assembly in its second (door-open) position. In this second position, biasing means 32 is compressed, thereby urging the piston-like assembly towards first end 24 of cylindrical housing 22. As is well known, typically piston head 30 includes an O-ring 34 disposed circumferentially on piston head 30. O-ring 34 creates a partial seal with the inside wall of cylindrical housing 22. As such, when the piston-like assembly is forced towards first end 24 by biasing means 32, the air inside cylindrical housing 22 is forced out of first end 24 through the controlling means 35. The rate at which the pistonlike assembly returns to first end 24 can therefore be controlled by varying the rate at which the air exits the cylindrical housing 22 through controlling means 35.

Figure 4:
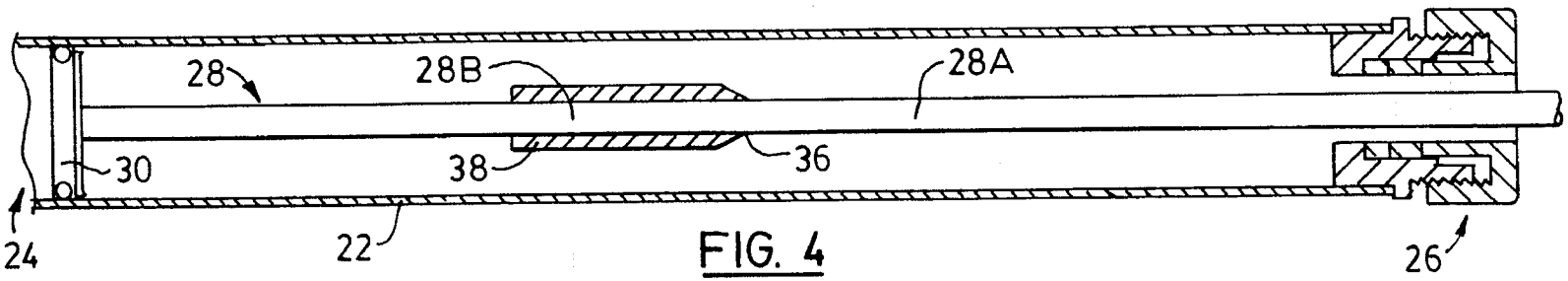
FIG. 4 is also a schematic representation of a cross-sectional view of the closing device of the present invention, but with the biasing means omitted.
Figure 5:
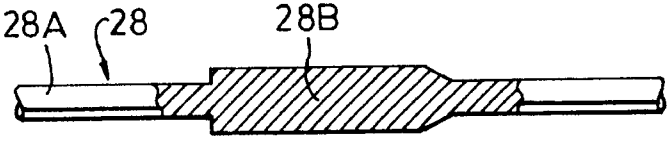
FIG. 5 is a schematic representation of a partial view of the shaft of the piston-like member.

Referring to FIGS. 4 and 5, shaft 28 of door closing device 14 of the present invention is shown in greater detail. Shaft 28 is generally cylindrical (rod-like) in shape. Its diameter varies along the length of shaft 28 such that a portion 28A of shaft 28 has a smaller diameter than the other portion 28B.

As shown in FIGS. 4 and 5, the diameter of a portion 28B of shaft 28 adjacent to piston head 30 is larger than the diameter of the portion 28A of shaft 28. The distance between piston head 30 and the point 36 where the diameter of shaft 28 decreases will be dependent on the overall size of door closing device 14. The location of point 36, at which the diameter of shaft 28 decreases is important as it determines to what extent door 10 must be opened in order for door closing device 14 to be able to keep door 10 opened for the predetermined period of time. This will be explained in greater detail below.

In the embodiment shown in FIG. 4, the diameter of portion 28B of shaft 28 is increased by inserting shaft 28 into a tube or sleeve 38. Alternatively, as shown in FIG. 5, shaft 28 can be integrally constructed with portions 28A and 28B of different diameters instead of having a separate tubing or sleeve, or the like, slipped over shaft 28.

Figure 6:
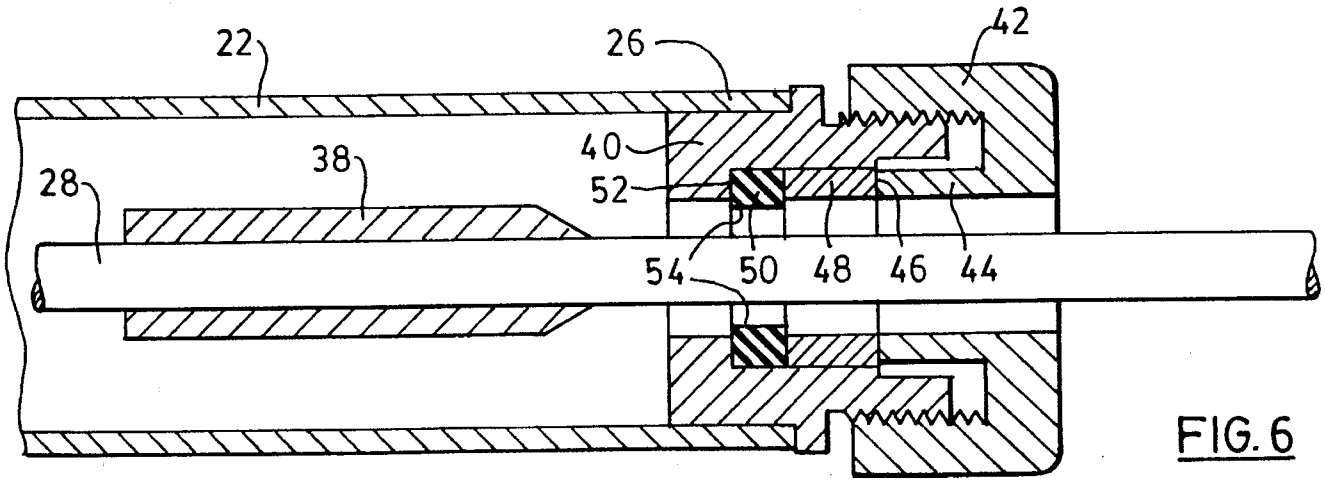
FIG. 6 is a schematic representation, in greater detail, of a partial cross-sectional view of the closing device of the present invention.

Referring to FIG. 6, the second end 26 of the hollow cylindrical housing 22 is fitted with a compression base 40 on which a compression nut 42 is screwed. Compression nut 42 includes an internal cylindrical portion 44 having an end 46. Also provided with door closing device 14 of the present invention is an annular spacer 48 and a flexible rubber washer 50. Spacer 48 is disposed within compression base 40 and adjacent to the end 46 of the compression nut 42. Flexible washer 50 sits within a space defined by annular spacer 48 and wall 52 of compression base 40.

The size and shape of flexible washer 50 is controlled or determined by the relative position of spacer 48 and wall 52. Thus, as spacer 48 is brought closer to wall 52, flexible rubber washer 50 is compressed so that inner faces 54 of flexible washer 50 are brought closer together. On the other hand, as spacer 48 is moved further away from wall 52, flexible washer 50 is decompressed allowing faces 54 to return to their original position.

The relative position of spacer 48 to wall 52 is determined by compression nut 42. The more compression nut 42 is screwed onto compression base 40, the more inner cylinder 44 causes spacer 48 to move towards wall 52, thereby compressing flexible rubber washer 50. It will be seen that compression base 40 remains immobile regardless of how much compression nut 42 is tightened. Thus, the distance between faces 54 of flexible rubber washer 50 is controlled by the tightening or loosening of compression nut 42 on compression base 40.

The size of the flexible rubber washer 50 is such that the distance between faces 54 is greater than the diameter of portion 28A of shaft 28. This is the case no matter how compressed flexible washer 50 is. However, the distance between faces 54 is at least the same, or smaller than the diameter of the portion 28B of shaft 28. Of course, the more compression nut 42 is tightened on compression base 40, the more flexible washer 50 is compressed, thus decreasing the distance between faces 54.

In operation, closing device 14 is connected to door 10 and frame 12 as shown in FIGS. 1A and 1B. As door 10 is opened, shaft 28 is forced out of cylindrical housing 22, causing piston head 30 to move towards second end 26. If shaft 28 is only forced out to a point where portion 28A of shaft 28 is adjacent to faces 54 of the washer 50, then door closing device 14 operates as an existing closing device in the usual manner. This is because faces 54 of washer 50 do not contact shaft 28.

On the other hand, if shaft 28 is extended out further so that the portion 28B of shaft 28 is adjacent to flexible washer 50, faces 54 of washer 50 contact shaft 28. The frictional forces between faces 54 of washer 50 and portion 28B of shaft 28 slows down the movement of shaft 28 and of piston head 30 towards first end 24. As compression nut 42 is tightened, the distance between faces 54 decreases such that the frictional forces between faces 54 of washer 50 and portion 28B of shaft 28 are increased. Thus, the rate of movement of the piston-like assembly towards first end 24 is decreased correspondingly.

Accordingly, door closing device 14 of the present invention is activated when shaft 28 is extended out of cylindrical housing 22 to the extent that point 36 passes beyond faces 54 of washer 50. When this occurs, portion 28B of shaft 28 is in frictional contact with faces 54 thereby slowing down the rate at which the piston-like assembly is forced back towards first end 24 of the cylindrical housing 22 by the biasing means 32. The piston-like assembly will slowly move towards first end 24 until point 36 is adjacent to the faces 54 of washer 50. Once this occurs, contact between faces 54 and shaft 28 is released, thereby allowing door closing device 14 to operate in the usual manner.

Therefore, the device of the present invention is essentially a modification to existing closing devices commonly used on storm doors. The closing device of the present invention allows the storm door, if it is sufficiently opened, to close relatively slowly for a fixed period of time and then to close more quickly in the usual manner. Door closing device 14, therefore, causes the door to close very slowly if the door is simply hyperextended by an arc in the range of, for example, 3° to 7°, beyond the normal open position. The door closes slowly throughout this arc of hyperextension, and thereafter the door operates in the usual manner.

The closing device 14 of the present invention can be used to modify existing closing devices by the addition of compression base 40, compression nut 42, spacer 48 and flexible washer 50. As well, the diameter of portion 28B of shaft 28 must be increased. All parts, except for tubing 38, replace the pre-existing caps found on existing closing devices. All parts may be made of either polymeric compositions or metallic construction with the exception of flexible rubber washer 50, which must be compressible, especially an elastomeric composition.

In summary of this disclosure, the closing device of the present invention allows the user to cause an exterior storm door, or any door, lid, window, etc. to be held in an open position for a pre-determined period of time, following which the door closes in the usual manner.

Modifications and alterations to the present invention are possible and all such modifications and alterations are within the sphere and scope of the present invention as described herein. For instance, it is understood that the door closing device could also have a mechanical locking device on the shaft external to the cylindrical housing, as is known, for purpose of being able to hold the door open for extended periods of time.

I claim:

1. An adjustable delayed-action door closing device comprising:

a cylindrical housing having first and second ends, adapted to be attached by said first end to said door;

a piston disposed within with said cylindrical housing, said piston comprising a shaft and a piston head, said shaft extending beyond said cylindrical housing from said second end and having attachment mean, thereon;

a biasing mechanism to urge said piston into said cylindrical housing and a controlling mechanism on said second end adapted to control said piston as it is so urged;

said shaft of said piston having a first section of one diameter and a second section of greater diameter than said first section:

a compression member cooperatively located within said second end of said cylindrical housing through which said shaft passes, said compression member being compressible to a diameter equal to or less than said second section, to provide friction contact with said second section when said second section is located within said compression member; and a mechanism to pre-set and adjust the degree of friction contact of said compression member and said second section (of the shaft with greater diameter).

2. The door closing device of claim 1 in which said compression member is compressible to a diameter of less than said first section.

3. The door closing device of claim 2 in which said compression member is formed from an elastomeric material.

4. The door closing device of claim 3 in which said compression member is a washer.

5. The door closing device of claim 3 in which the compressible member is compressed using a compression nut located at second end of said cylindrical housing.

6. The door closing device of claim 3 in which said shaft is a rod.

7. The door closing device of claim 3 in which said second section is a sheath positioned on said shaft.

8. The door closing device of claim 3 in which said biasing mechanism is a spring.

9. The door closing device of claim 3 in which said door is selected from the group consisting of a screen door and a storm door.

10. The door closing device of claim 5 in which said second section is juxtaposed to said piston head.

* * * * *